US005649332A

United States Patent [19]

Wells et al.

[11] Patent Number: 5,649,332

[45] Date of Patent: Jul. 22, 1997

[54] POSTURIZED CONTINUOUS MATTRESS SPRING CORE

[75] Inventors: Thomas J. Wells; Steven E. Ogle, both of Carthage, Mo.

[73] Assignee: L&P Property Management Company, Chicago, Ill.

[21] Appl. No.: 616,207

[22] Filed: Mar. 15, 1996

[51] Int. Cl.[6] ..... A47C 27/04

[52] U.S. Cl. ..... 5/727; 5/716; 5/268; 5/269; 217/93

[58] Field of Search ..... 5/268, 269, 716, 5/717, 727, 260; 267/91, 93

[56] References Cited

U.S. PATENT DOCUMENTS

| | | | |
|---|---|---|---|
| 4,625,349 | 12/1986 | Higgins | 5/716 X |
| 4,679,266 | 7/1987 | Kraft . | |
| 4,905,333 | 3/1990 | Scott | 5/716 |
| 4,918,773 | 4/1990 | Scott . | |
| 4,960,267 | 10/1990 | Scott | 5/717 X |
| 4,972,536 | 11/1990 | Scott . | |
| 5,139,054 | 8/1992 | Long et al. . | |

FOREIGN PATENT DOCUMENTS 2143731 12/1986 United Kingdom .

*Primary Examiner*—Michael F. Trettel
*Attorney, Agent, or Firm*—Wood, Herron & Evans, L.L.P.

[57] ABSTRACT

A spring interior of a mattress comprising a plurality of longitudinally extending bands of springs disposed side by side and connected together with helical lacing wires in the top and bottom faces of the bands. Each band of springs comprises a single length of wire formed into a plurality of coil springs interconnected by innerconnecting segments located alternatively in the top and bottom faces of the bands. The spring interior is characterized by longitudinally extending sections of differing firmnesses throughout the length of the spring interior. The different firmnesses in the different sections of the spring interior are attributable to different configurations of the innerconnecting segments. The innerconnecting segments within the firmer sections of the mattress have a deeper V-shaped indentation than the portions of the bands of springs in the less firm sections of the mattress.

13 Claims, 3 Drawing Sheets

POSTURIZED CONTINUOUS MATTRESS SPRING CORE

FIELD OF THE INVENTION

The present invention relates to a bedding mattresses and more particularly to the spring interior of a bedding mattress.

DESCRIPTION OF THE PRIOR ART

A known form of spring interior of a bedding mattress having a relatively long longitudinal dimension and a relatively shorter transverse dimension comprises a plurality of longitudinally extending bands of springs disposed side-by-side and connected by helical lacing wires which extend transversely of the bands and embrace portions of the bands. Several kinds of bands of springs have been proposed for incorporation in spring interiors of bedding mattresses. One kind of band, which is the subject of British Patent No. 2,143,731 will hereinafter be referred to as a band of interlocked or interlaced springs. Each such band comprises a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a rotational hand opposite to the rotational hand of the adjacent coils immediately before and after it in the row and being joined to the adjacent coil springs by a plurality of innerconnecting segments of wire integral with the coil springs. One of the pair of innerconnecting segments is located in the bottom face of the band and the other of the pair of innerconnecting segments is located in the top face of the band. Each innerconnecting segment comprises a bridging portion between adjacent coils, which bridging portion extends lengthwise of the row.

When bands of interlocked springs of the type described hereinabove are assembled to form a spring interior they are disposed side-by-side and interconnected with helical lacing wires, some of which lie in the top face of the spring interior and others of which lie in the bottom face of the spring interior. The top and bottom faces of the spring interior being the faces defined by the top and bottom faces of the bands of springs incorporated into the spring interior. Each helical lacing wire extends across the bands of springs and embraces portions of wires of the bands that extend transversely of the bands from the ends of the bridging portions of the innerconnecting segments. In the top and bottom faces of the spring interior the helical lacing wires are disposed at uniform intervals along the bands of springs such that there are two coil springs disposed in the interval between each helical lacing wire and the next adjacent helical lacing wire.

It is customary for a bedding spring interior to be incorporated into an upholstered article. In such an article at least one of the main faces of the spring interior is covered by a layer or layers of padding. This in turn is covered by a cover made of sheet material such as ticking or upholstery fabric.

When a person reclines on top of a mattress in a conventional manner pressure is applied unevenly to the top surface of the mattress. This uneven pressure or uneven loading of the surface is a consequence of uneven weight distribution of a person reclining on the top surface of the mattress. As is well known the heaviest portion of the body is located approximately midway along the length of the body and consequently a person reclining on top of a mattress can cause the mattress to deflect or sag to a greater extent in the lengthwise center of the mattress than at the ends of the mattress. This uneven deflection in turn results in a person reclining on top of the mattress with an unnatural or uncomfortable misalignment imparted to his or her spine due to the middle portion of the body being lower than the legs or upper portion of the body. To counteract this uneven deflection of the mattress when a person is reclining on top of the mattress, one proposal has been to reinforce or make firmer selected sections such as the middle third of a mattress. Increasing the firmness of selected sections of the mattress has been accomplished by increasing the number or density of springs in the center section of the mattress, using different or firmer springs in the center section of the mattress, or adding additional structure such as foam blocks to the center section of the mattress to reinforce that section and make it firmer than the two end sections of the mattress.

Two patents, U.S. Pat. No. 4,052,760 and U.S. Pat. No. 4,679,226, disclose mattresses having differing zones of differing firmnesses in the spring core of the mattress due to differing coil springs within the spring core. In selected longitudinally extending zones of the spring core increased firmness is obtained by utilizing conventional coil springs of a heavier gauge wire than the coil springs making up the other non-selected longitudinally extending zones of the spring core which are of a lesser firmness than the selected zones. However, one problem with this type of mattress and all other mattresses which are characterized by multiple zones of differing firmness attributable to differing characteristics of the coil springs which make up the spring core of the mattress is that such a multiple zoned mattress has been relatively expensive to manufacture, primarily because of the difficulty of automating the manufacture and particularly the assembly of such mattress spring core assemblies.

U.S. Pat. No. 4,972,536 issued to the assignee of the present invention discloses a mattress spring core made up of a plurality of continuous bands of coil springs rather than individual coil springs. The bands of springs extend transversely of the mattress and the helical lacing wires connecting the bands of springs extend longitudinally of the mattress, The mattress spring core is divided into a plurality of longitudinally extending zones of differing firmnesses due to differing characteristics of the bands of springs in the differing zones. The transversely extending bands of springs in the different longitudinally extending zones may be made of differing gauge wire or of differing heights to alter the firmness in the different longitudinally extending zones of the mattress. If the transversely extending bands of springs are of different gauge wire to impart different degrees of firmness to different longitudinally extending zones of the mattress, the cost of manufacture is greater than the cost of manufacturing a mattress of uniform firmness in which the bands of spring are of the same gauge wire.

Another concept used to impart differing degrees of firmness to different longitudinally extending zones of a mattress is disclosed in U.S. Pat. No. 4,918,773 also assigned to the assignee of the present invention. In this mattress spring core the different zones of firmness are attributable to a plurality of posture rods which extend through interlaced portions of a plurality of pairs of interlaced coils of the spring interior. Again the springs are not individual coil springs but rather are continuous bands of springs. The firmness of any particular zone can be altered by increasing or decreasing the number of posture rods in that particular zone or altering the characteristics of the posture rods. Increasing the firmness of one or more zones of a mattress by posture rods as in this patent requires additional elements, thereby increasing the cost and time needed for assembly.

It has therefore been an objective of the present invention to provide an improved bedding mattress spring interior having multiple longitudinally extending zones of differing firmnesses which is cost effective to manufacture.

It has been another objective of the present invention to provide a bedding mattress spring interior having multiple longitudinally extending zones of differing firmnesses without the addition of any additional parts or elements.

It has been a further objective of the present invention to provide a bedding mattress spring interior having multiple longitudinally extending zones of differing firmnesses without varying the gauge of the wire used to make the spring interior.

SUMMARY OF THE INVENTION

The invention of this application which accomplishes these objectives comprises a bedding mattress spring interior comprising a plurality of parallel bands of springs interconnected with helical lacing wires. The spring interior is separated into a plurality of regions, each region being of differing firmness due to different characteristics of different portions of the bands of springs. The bands of springs are identical and each band of springs comprises a single length of wire shaped to form a plurality of individual coil springs arranged in a row. One end turn of each coil spring lies adjacent to a top face of the band and the other end turn of each coil spring lies adjacent to a bottom face of the band. Each coil spring is of a hand opposite to the hand of the adjacent coil springs immediately before or after it in the row. Each coil spring is joined to adjacent coil springs by innerconnecting segments integral with the coil springs. One of the innerconnecting segments is located substantially in the top face of the band and the other of the innerconnecting segments is located substantially in the bottom face of the band. Each innerconnecting segment comprises a bridging portion which extends lengthwise of the row and two end segments which extend transversely of the row. The bands are disposed side by side so that their top faces lie in the top main face of the spring interior and their bottom main faces lie in the bottom main face of the spring interior. The bands are interconnected with helical lacing wires which extend transversely across the bands in the top and bottom main faces of the spring interior. Each helical lacing wire encircles portions of the bands from the ends of the bridging portions thereof. Two coil springs exist in the interval between each helical lacing wire and the adjacent helical lacing wire.

The spring interior is separated into multiple longitudinally extending regions of differing firmnesses. The differing firmnesses of the different longitudinally extending zones or regions are attributable to differing characteristics of the bridging portions of the bands of springs. The bridging portions of the bands of springs each comprise two end portions and a center portion. The center portion is a V-shaped indentation lying in the top or bottom face of the band. The depth of the V-shaped indentation determines the firmness of a particular longitudinally extending zone of the spring interior. The deeper the "V" extends inwardly towards the axes of the coil springs of the band of springs in a particularly longitudinally extending zone, the firmer that longitudinally extending zone of the spring interior and the closer together the end segments of the innerconnecting segments are to each other. The spring interior may have one or more regions of increased firmness in which the V-shaped indentations of the bridging portions of the innerconnecting segments of the bands of springs are deeper than the V-shaped indentations in the bridging portions in the other less firm regions or zones of the mattress spring interior.

All of the bands of springs are of the same gauge wire making automation of the manufacture and assembly of the spring interior easier and more cost efficient than all heretofore known mattress spring interiors of differing firmnesses.

These and other objects and advantages of this invention will become more readily apparent from the following description of the drawings in which:

DESCRIPTION OF THE PREFERRED EMBODIMENT

Figure 1:
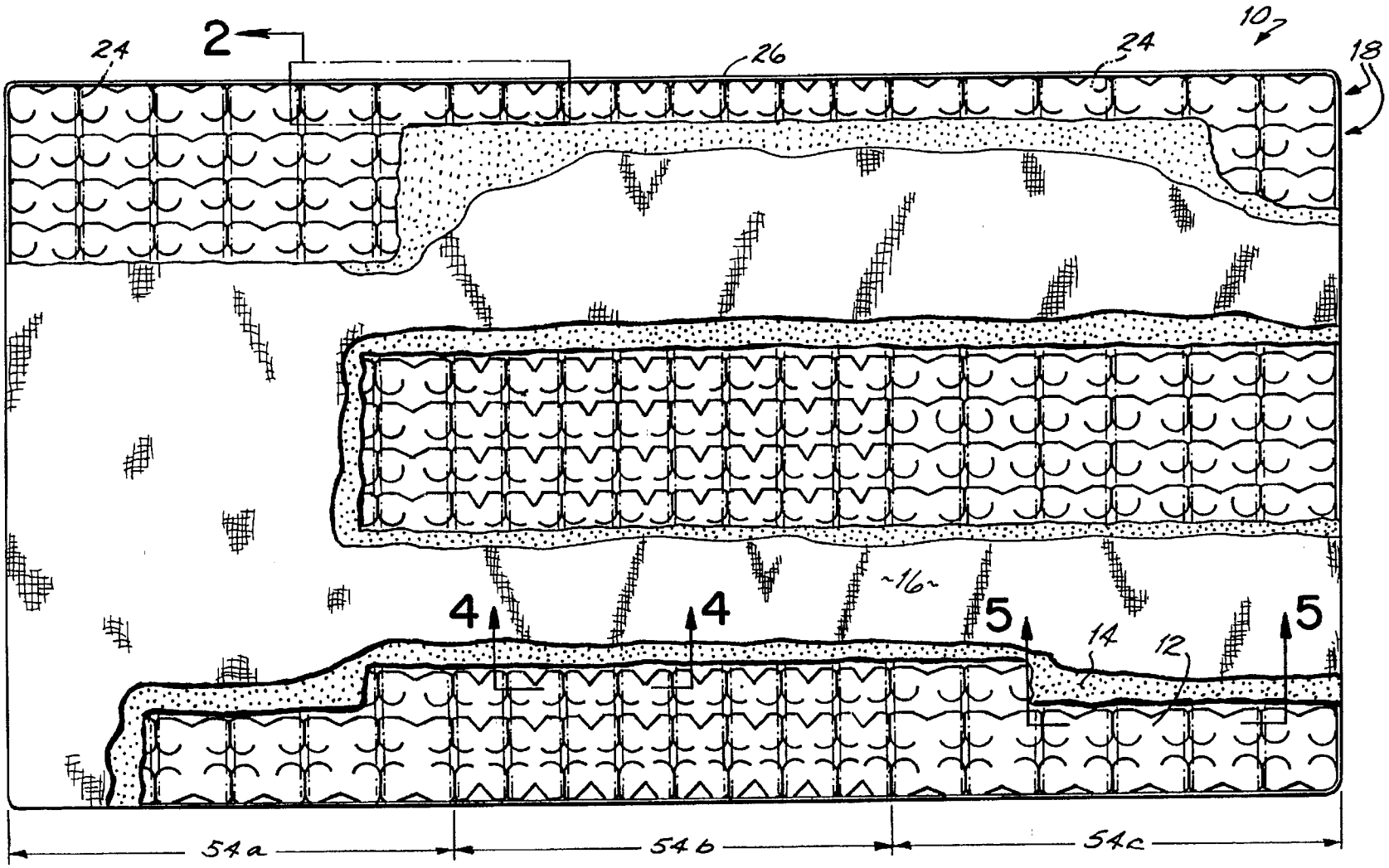
FIG. 1 is a top plan view partially broken away of a mattress incorporating the invention of this application.

Referring to the drawings, and particularly to FIG. 1 there is illustrating a bedding mattress 10 having a plurality of longitudinally extending zones of differing firmnesses. The bedding mattress 10 comprises a spring interior 12, a padding overlay 14 which covers the top surface of the spring interior 12 and a fabric cover 16 enclosing the spring interior 12 and padding overlay 14.

The spring interior 12 which is the subject of this invention comprises a plurality of parallel bands of springs 18 which extend longitudinally of the mattress. These bands of springs 18 are laced together with helical lacing wires 24 which extend transversely of the spring interior across the bands of springs 18 and secure the bands of springs in an assembled relation. A border wire 26 extends completely around the periphery of the spring interior in the top and bottom planes 28, 30 respectively of the spring interior. The border wire 26 is secured to the outermost edge of the spring interior 12 in these top and bottom planes by conventional sheet metal clips 32 or any other conventional fastener.

Figure 2:
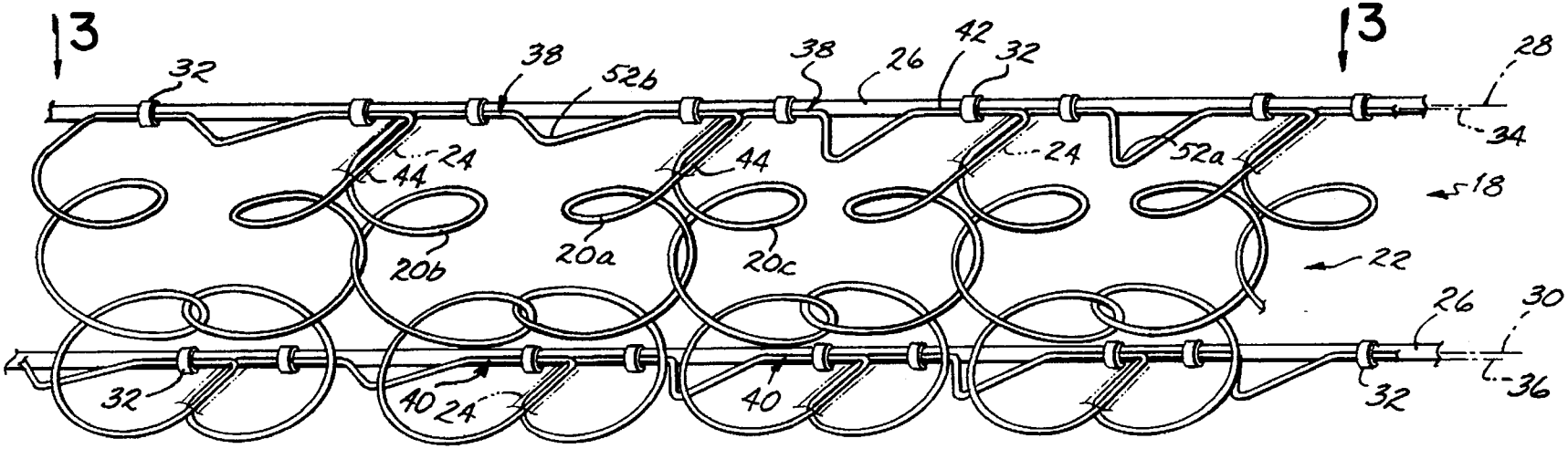
FIG. 2 is a perspective view of an enlarged portion of the designated area 2 of FIG. 1 illustrating two different V-shaped indentations of the differing regions of the spring interior.

Each band of springs 18, a portion of which is illustrated in perspective in FIG. 2, is made of a single length of spring wire shaped to form a plurality of individual coil springs 20 arranged in a row 22. Each coil spring 20 comprises about two and one-half turns of wire and defines a spring axis 33. The end turns of the coil springs 20 lie adjacent to the top and bottom faces 34, 36 respectively of the band of springs. Each coil spring 20, such as that numbered 20*a* (FIG. 2), is so coiled as to have a hand opposite to the hand of the adjacent coil springs, such as 20*b* and 20*c*, immediately before and after it in the row. Each coil spring 20 is joined to the next adjacent coil springs by two innerconnecting segments 38, 40 (see FIG. 2) of the wire integral with the coil springs. One 38 of the two innerconnecting segments 38, 40 is in the top face 34 of the band 18 and the other innerconnecting segment 40 is in the bottom face 36 of the band 18. For example, coil spring 20*a*, (FIG. 2) is connected to coil spring 20*b* by innerconnecting segment 38, which is in the top face of the band 34 and to coil spring 20*c* by innerconnecting segment 40, which is in the bottom face of the band 36. Each innerconnecting segment 38, 40 comprises a bridging portion 42 which extends lengthwise of the row, and two end segments 44 which extend in a direction normal to the bridging portion 42. The end segments 44 of each innerconnecting segment 38, 40 lie in either the top or bottom faces of the band 34, 36.

Each bridging portion 42, in addition to extending longitudinally of the band, also has a center portion 48 and two end portions 50 on either end of the center portion 48. The center portion 48 of each bridging portion 42 comprises a V-shaped indentation 52. The V-shaped indentation 52 of wire lies halfway between the end segments 44 of the innerconnecting segment 38, 40 of which it forms a part and extends transversely to the direction of the band. These V-shaped indentations of wire 52 lie in either the top or bottom face of the band, as the case may be and partially serve to support a person reclining on top of the mattress.

As seen in FIG. 1, the mattress 10 is divided into a plurality of longitudinally extending regions or zones 54, each zone being of a different firmness due to the different characteristics of the bridging portions 42 of the innerconnecting segments 38, 40 of the bands of the spring interior. FIG. 1 illustrates longitudinally extending bands of springs 18 connected with helical lacing wires 24 running transversely of the bands. Such an orientation divides the spring interior 12 into a plurality of longitudinally extending zones 54 of differing firmnesses. As seen in FIG. 1, the spring interior 12 is divided into three separate longitudinally extending zones; a head section 54*a*, a center section 54*b* and a leg section 54*c*. Although FIG. 1 illustrates three separate longitudinally extending zones or regions 54 of a mattress, the spring interior of the mattress 12 may be separated into any number of longitudinally extending zones or regions 54 in accordance with the spirit of this invention. Alternatively, the bands of springs 18 could run transversely rather than longitudinally and the spring interior be separated into a plurality of transversely extending regions or zones of different firmnesses due to differing characteristics of portions of the transversely extending bands of springs.

In the mattress spring interior 12 illustrated in FIG. 1 the center section 54*b* is of increased firmness relative to the head and leg sections 54*a*, 54*c*, respectively of the spring interior 12. The difference in firmness of the different sections or zones 54 of the mattress is attributable to each band of springs 18 having several different portions of differing resiliency or rigidity. The differing resiliencies are due to different configurations of the innerconnecting segments 38, 40 within a band of springs 18. The V-shaped indentations 52*a* in the center portions of the bridging portions 42 of the innerconnecting segments within the center section 58 of the spring interior 12 are deeper than the V-shaped indentations 52*b* of the innerconnecting segments within the head and leg sections 54*a*, 54*c* of the spring interior. By a deeper V, what is meant is that the V-shaped indentation protrudes further away from the end portions of the bridging portion of the innerconnecting segments thus drawing the two end segments 44 of the innerconnecting segments 38, 40 closer together. This increases the spring density or number of coil springs within a certain longitudinal dimension of the spring interior and increases the firmness in the densified region or zone.

Typically the center section or middle third of a mattress spring core is the portion of the mattress in which increased firmness is desired so as to reduce the deflection of the middle section of the spring interior when a person reclines upon the mattress. The middle portion of a person's body is typically heavier than the upper and lower portions of the body so that when a person lies on a mattress of uniform firmness the middle portion of the body causes a greater deflection of the coil springs in the middle portion of the mattress and hence stresses the spine of the user reclining on top of the mattress. With the middle portion of each band of coil springs of increased density and more resiliency in the middle third of the mattress the middle section of the mattress spring interior is of increased firmness and aids in reducing the distortion of the spine of the person reclining on top of the mattress.

Figure 3:
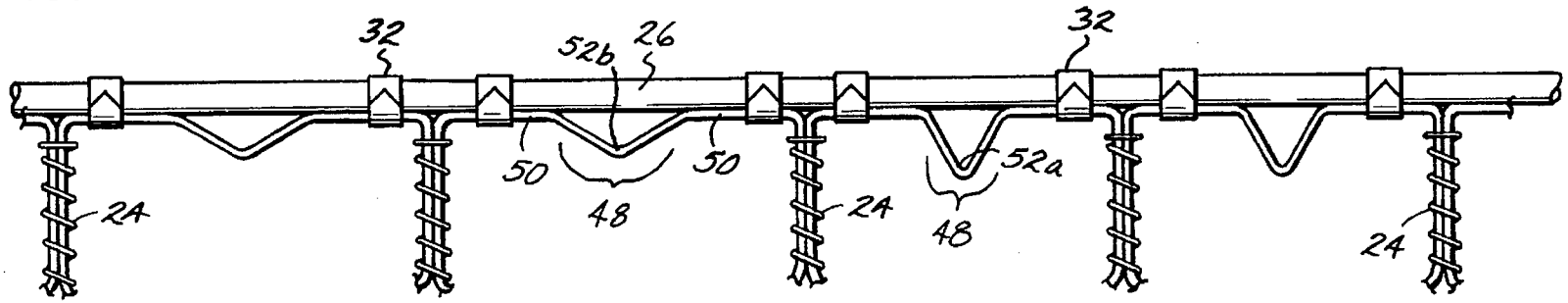
FIG. 3 is a top plan view taken along the lines 3—3 of FIG. 2.
Figure 3A:
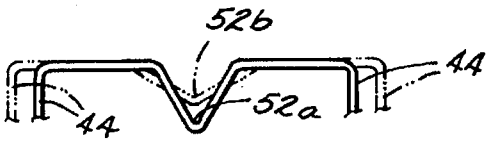
FIG. 3A is a top plan view of the bridging portions of the two different regions of the spring interior of FIG. 3 superimposed upon one another.

As best illustrated in FIGS. 2 and 3 in both the top and bottom planes of the bands of springs 18 the V-shaped indentations 52*a* of the bridging portions 42 of the innerconnecting segments 38, 40 of the bands of springs in the center section of the mattress protrude inwardly so that the two end segments 44 of the innerconnecting segments 38, 40 come closer together thus increasing the resiliency or firmness of the coil springs within that particular region. FIG. 3A illustrates a V-shaped indentation 52*a* of an innerconnecting segment within the center section 54*b* of the mattress spring interior 12 superimposed on top of a V-shaped indentation 52*b* of an innerconnecting segment within either the head or leg section 54*a*, 54*c* of the mattress illustrating the difference in the configurations of the V-shaped indentations of the bridging portions within the different sections of the mattress.

Figure 4:
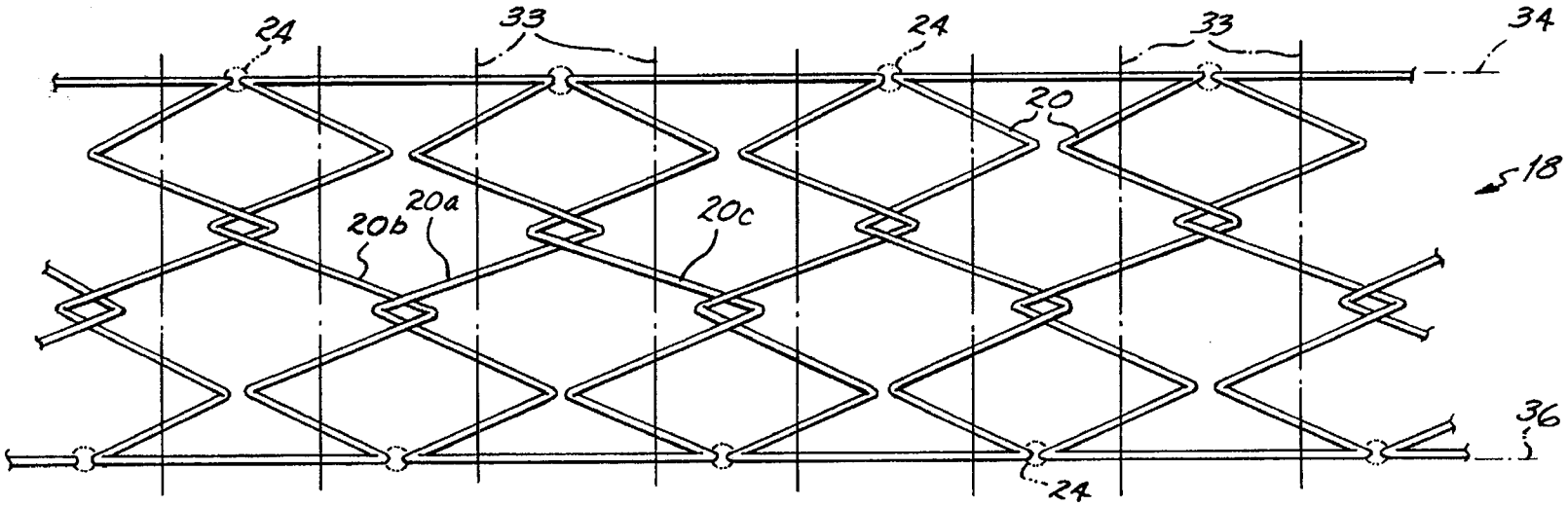
FIG. 4 is a cross-sectional view taken along the lines 4—4 of FIG. 1.
Figure 5:
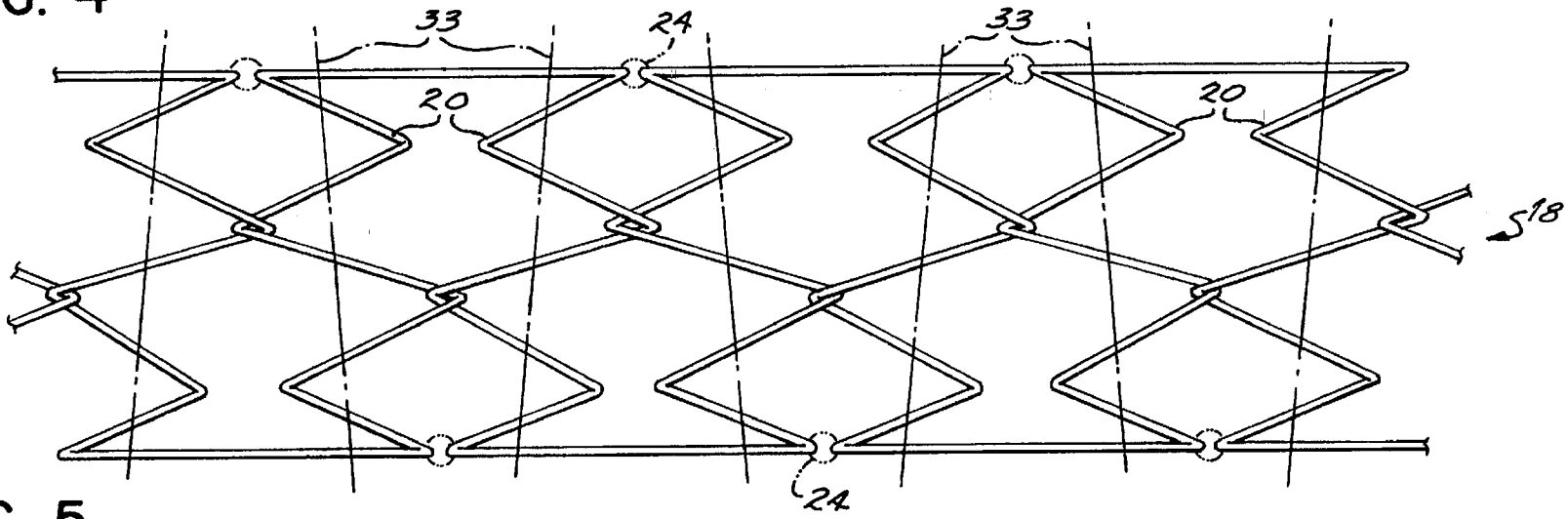
FIG. 5 is a cross-sectional view taken along the lines 5—5 of FIG. 1.

As best illustrated in FIGS. 2, 4 and 5 the adjacent coil springs 20 within a band of springs 18 are interlaced or interwoven to the extent of having one intermediate turn of each coil spring interwoven with one intermediate turn or revolution of each adjacent coil spring. That is, and with reference to FIGS. 2 and 4, the coil spring 20*a* has one intermediate turn or revolution interlaced or interwoven with an intermediate revolution of adjacent coil spring 20*c* and another turn or revolution interwoven or interlaced with one intermediate turn of the adjacent coil spring 20*b*. Thus each coil spring, except for the endmost coil springs of a band of springs 18, has two intermediate turns or revolutions interlaced with intermediate turns or revolutions of the two adjacent coil springs, and the endmost coil spring has one intermediate turn or revolution interlaced with one intermediate turn or revolution of the adjacent coil spring of the same band of springs.

As illustrated in FIGS. 4 and 5, each coil spring 20 of a band of springs 18 has an axis 33. As illustrated in FIG. 5, in the head or leg section of the mattress or any section of a lesser firmness than other sections of a mattress, the axis 33 of each coil spring 20 is not upright, but is inclined slightly lengthwise of the band, each spring axis 33 being inclined in a direction opposite to that of the axes of the two adjacent springs in the row. As best illustrated in FIG. 5, the axes 33 of two adjacent coil springs 20 converge toward one another as they extend from the top plane to the bottom plane of the spring interior or from the bottom plane to the top plane of the spring interior, the axes being closest together at the locations of the helical lacing wires.

As illustrated in FIG. 4, in the firmer center section of the mattress spring interior 54*b* having the deep V indentations in the bridging portions of the innerconnecting segments, the axes 33 defined by the coil springs 20 are substantially vertical rather than inclined. The differing angulation of the axes of the springs derives from the fact that the assembly is first assembled and the lacing wires applied to the assembly with all of the innerconnecting segments having the same deep V indentations and then after assembly, the coils in the less firm sections are spaced apart by diminishing the depth of the indentations.

Although FIG. 1 shows the center section of a mattress spring interior to be approximately one-third of the longitudinal dimension of the mattress, the selected firmer section of a mattress spring interior may be any other fraction of the total longitudinal dimension of the spring interior. Further, any number of individual sections of increased firmness or rigidity may be incorporated into the spring core utilizing the invention of this application.

While I have described only one preferred embodiment of my invention, persons skilled in the art to which it applies will appreciate changes and modifications which may be made without departing from the spirit of my invention. Therefore, I do not intend to be limited except by the scope of the following appended claims:

We claim:

1. A bedding mattress comprising:

a spring interior having a relatively long longitudinal dimension and a relatively shorter transverse dimension and top and bottom main faces, said spring interior having a plurality of parallel bands of springs, each band of springs comprising a single length of wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before or after it in the row and being interlaced with the adjacent coil springs of the same row, each coil spring being joined to said adjacent coil springs by innerconnecting segments integral with the coil springs, one of said innerconnecting segments being located substantially in the top face of the band and the other of said innerconnecting segments being located substantially in the bottom face of the band, and each innerconnecting segment comprising a bridging portion which extends lengthwise of the row, the bands being interconnected with helical lacing wires lying in the top and bottom main faces of the spring interior and extending transversely across the bands, each helical lacing wire encircling portions of the bands from the ends of said bridging portions thereof, two coil springs being in the interval between each helical lacing wire and the next;

said spring interior being separated into multiple regions, each said region comprising portions of multiple parallel bands of said springs, each said region comprising a plurality of substantially identically shaped bridging portions of each band of springs; said bridging portions of at least two of said regions having differing shape characteristics so as to impart differing firmnesses to said regions;

padding overlying at least one main face of said spring interior; and an upholstered covering material encasing said spring interior and said padding.

2. A spring interior having a relatively long longitudinal dimension and a relatively shorter transverse dimension and top and bottom main faces, said spring interior having a plurality of parallel bands of springs, each band of springs comprising a single length of wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before or after it in the row and being interlaced with the adjacent coil springs of the same row, each coil spring being joined to said adjacent coil springs by innerconnecting segments integral with the coil springs, one of said innerconnecting segments being located substantially in the top face of the band and the other of said innerconnecting segments being located substantially in the bottom face of the band, and each innerconnecting segment comprising a bridging portion which extends lengthwise of the row, the bands being interconnected with helical lacing wires lying in the top and bottom main faces of the spring interior and extending transversely across the bands, each helical lacing wire encircling portions of the bands from the ends of said bridging portions thereof, two coil springs being in the interval between each helical lacing wire and the next;

said spring interior being separated into multiple regions, each said region comprising portions of multiple parallel bands of said springs, each said region comprising a plurality of substantially identically shaped bridging portions of each band of springs, said bridging portions of at least two of said regions having differing shape characteristics so as to impart differing firmnesses to said regions.

3. The spring interior of claim 2 wherein said bands of springs extend longitudinally of the spring interior.

4. The spring interior of claim 2 wherein said regions of said spring interior are longitudinally extending, the springs within each longitudinally extending region being identically configured.

5. The spring interior of claim 2 wherein each of said bridging portions of said bands of springs comprises two end portions and a center portion, said center portion being a V-shaped indentation lying in the top or bottom face of the band.

6. The spring interior of claim 5 wherein said differing firmnesses of said regions are attributable to differing V-shaped indentations in said center portions of said bridging portions of said bands of springs.

7. The spring interior of claim 5 wherein said regions of said spring interior of increased firmness contain bridging portions of said bands of springs with V-shaped indentations in said center portions of said bridging portions of greater depth than the V-shaped indentations of said center portions of said bridging portions in the other regions of said spring interior.

8. The spring interior of claim 5 wherein the distance between said end segments of each innerconnecting segment is greater in regions of lesser firmness than the distance between the end segments of each innerconnecting segment in at least one region of said spring interior of greater firmness.

9. A method of posturizing a bedding mattress, said method comprising the steps of:

providing a spring interior having a relatively long longitudinal dimension, a relatively shorter transverse dimension and top and bottom main faces, said spring interior having a plurality of parallel bands of springs, each band of springs comprising a single length of wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before or after it in the row and being interlaced with the adjacent coil springs of the same row, each coil spring being joined to said adjacent coil springs by innerconnecting segments integral with the coil springs, one of said innerconnecting segments being located substantially in the top face of the band and the other of said innerconnecting segments being located substantially in the bottom face of the band, and each innerconnecting segment comprising a bridging portion which extends lengthwise of the row;

interconnecting the bands with helical lacing wires lying in the top and bottom main faces of the spring interior and extending transversely across the bands, each helical lacing wire encircling portions of the bands from the ends of said bridging portions thereof, two coil springs being in the interval between each helical lacing wire and the next;

separating said mattress into multiple regions, said regions being of differing firmnesses, each said region comprising portions of multiple parallel bands of said springs, each said region comprising a plurality of substantially identically shaped bridging portions of each band of springs;

placing padding over at least one main face of said spring interior; and encasing said spring interior and said padding with an upholstered covering material.

10. A method of posturizing a bedding mattress, said method comprising the steps of:

providing a spring interior having a relatively long longitudinal dimension, a relatively shorter transverse dimension and top and bottom main faces, said spring interior having a plurality of parallel bands of springs, each band of springs comprising a single length of wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before or after it in the row and being interlaced with the adjacent coil springs of the same row, each coil spring being joined to said adjacent coil springs by innerconnecting segments integral with the coil springs, one of said innerconnecting segments being located substantially in the top face of the band and the other of said innerconnecting segments being located substantially in the bottom face of the band, and each innerconnecting segment comprising a bridging portion which extends lengthwise of the row;

interconnecting the bands with helical lacing wires lying in the top and bottom main faces of the spring interior and extending transversely across the bands, each helical lacing wire encircling portions of the bands from the ends of said bridging portions thereof, two coil springs being in the interval between each helical lacing wire and the next;

separating said mattress into multiple regions, said regions being of differing firmnesses, each said region comprising portions of multiple parallel bands of said springs, each said region comprising a plurality of substantially identically shaped bridging portions of each of said bands.

11. A method of posturizing a spring interior, said method comprising the steps of:

providing a plurality of parallel bands of springs extending longitudinally of the spring interior, each band of springs comprising a single length of wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before or after it in the row and being interlaced with the adjacent coil springs of the same row, each coil spring being joined to said adjacent coil springs by innerconnecting segments integral with the coil springs, one of said innerconnecting segments being located substantially in the top face of the band and the other of said innerconnecting segments being located substantially in the bottom face of the band, and each innerconnecting segment comprising a bridging portion which extends lengthwise of the row, said bridging portion comprising two end portions and a center portion, the bands being disposed side by side so that their top faces lie in a top main face of the spring interior and their bottom faces lie in a bottom main face of the spring interior;

interconnecting the bands with helical lacing wires encircling portions of the bands from the ends of said bridging portions thereof, two coil springs being in the interval between each helical lacing wire and the next; and separating said mattress into multiple regions, each region comprising a plurality of substantially identically shaped bridging portions of each band of springs, said regions being of differing firmnesses, said differing firmnesses being attributable to the shape of V-shaped indentations in said bridging portions of said bands.

12. The method of claim 11 wherein said step of separating the mattress into multiple regions comprises adjusting the end portions of the bridging portions so as to change the shape of the center portions of said bridging portions.

13. The method of claim 11 wherein said step of separating the mattress into multiple regions comprises bringing the end portions of the bridging portions closer together in order to make firmer selected regions of said mattress.

* * * * *